US008326691B1

(12) United States Patent
Rabenold et al.

(10) Patent No.: US 8,326,691 B1
(45) Date of Patent: Dec. 4, 2012

(54) REMOTE CONSIGNOR/BIDDER SUPPLEMENT FOR TRADITIONAL LIVE AUCTIONS

(75) Inventors: Nancy J. Rabenold, Brandon, FL (US); James A. Simmons, Brandon, FL (US)

(73) Assignee: XCIRA, Tampa, FL (US)

( * ) Notice: Subject to any disclaimer, the term of this patent is extended or adjusted under 35 U.S.C. 154(b) by 2012 days.

(21) Appl. No.: 10/397,600

(22) Filed: Mar. 26, 2003

Related U.S. Application Data

(60) Provisional application No. 60/367,557, filed on Mar. 26, 2002.

(51) Int. Cl.
*G06Q 30/00* (2012.01)

(52) U.S. Cl. ..... 705/26; 705/36 R; 705/37; 705/80; 705/401; 235/492

(58) Field of Classification Search ..... None
See application file for complete search history.

(56) References Cited

U.S. PATENT DOCUMENTS

| | | | | |
|---|---|---|---|---|
| 6,415,269 | B1 * | 7/2002 | Dinwoodie | 705/36 R |
| 6,449,601 | B1 * | 9/2002 | Friedland et al. | 705/37 |
| 6,704,716 | B1 * | 3/2004 | Force | 705/80 |
| 2002/0103740 | A1 * | 8/2002 | Maroney | 705/37 |
| 2002/0123959 | A1 * | 9/2002 | Mozley et al. | 705/37 |
| 2002/0147655 | A1 * | 10/2002 | Say | 705/26 |
| 2003/0130932 | A1 * | 7/2003 | Wong | 705/37 |
| 2003/0182222 | A1 * | 9/2003 | Rotman et al. | 705/37 |
| 2005/0027613 | A1 * | 2/2005 | Takekuma et al. | 705/26 |
| 2006/0112003 | A1 * | 5/2006 | Levy et al. | 705/37 |
| 2006/0206408 | A1 * | 9/2006 | Nassiri | 705/37 |

FOREIGN PATENT DOCUMENTS

EP 987644 A2 * 3/2000

* cited by examiner

*Primary Examiner* — Vanel Frenel
(74) *Attorney, Agent, or Firm* — Smith Risley Tempel Santos LLC; Gregory Scott Smith

(57) ABSTRACT

A method for adding a negotiation interface between remote consignors and bidders to a traditional-style live auction, comprising the steps of providing audio/video system apparatus; providing clerk system apparatus; providing marquee system apparatus; providing bid system apparatus; and providing negotiation apparatus for enabling selective direct price negotiations between remote auction consignors and remote auction bidders.

18 Claims, 6 Drawing Sheets

REMOTE CONSIGNOR/BIDDER SUPPLEMENT FOR TRADITIONAL LIVE AUCTIONS

This application claims the benefit of prior co-pending provisional patent application Ser. No. 60/367,557, filed Mar. 26, 2002.

BACKGROUND OF THE INVENTION

The traditional auction industry, especially that of professional dealers or wholesalers, is a very rapid pace event in which time is money for the auctioneer, auction company, consignor as well as the dealer or buyer/bidder. Many types of auctions use a "reserve price" scenario. If the item to be auctioned meets the specified price set by the consignor, the item is sold at that price, or higher. If the high bid does not meet the reserve price, then the consignor has the option of selling the item at the high bid, the bidder has the option of meeting the reserve price, or the consignor and bidder can negotiate a price. Currently, all negotiations are done by consignors sending a representative to the live auction block, or are done by phone at the initiative of the live auction, and typically occur at a much later time. With the increasing utilization of technology in the auction environment, it is necessary to provide the technological capability for both a remote bidder and a remote consignor to negotiate during the bidding process, instantaneously, and without disrupting the live auction flow. This capability is essential to providing immediate feedback to both the bidder and the consignor as a price negotiation is conducted.

If the consignor has met the consignor's overall objectives for the auction sale, the consignor may be willing to sell any item at a much lower price than the reserve price in order to reduce inventory and carrying costs. If a bidder needs that specific item to complete the bidder's sale objectives, the bidder may be willing to pay a higher price than the bidder's previous high bid. The ability for both the bidder and the consignor to be remote from the auction facility also provides the ability for a consignor to represent his items to be auctioned at multiple concurrent auctions and represents an opportunity for both the consignor and the bidder to significantly reduce travel costs.

SUMMARY OF THE INVENTION

The remote consignor/bidder supplement for traditional live auctions of the present invention is a modular addition to the Remote Bidding Supplement for Traditional Live Auctions of U.S. patent application Ser. No. 09/866,191, the disclosure of which is incorporated by reference as if fully set forth herein. The Remote Bidding Supplement for Traditional Live Auctions of U.S. patent application Ser. No. 09/866,191 provides the infrastructure for the following elements of the remote consignor/bidder supplemental for traditional live auctions of the present invention:

- Instantaneous audio and video from the live auction site to the remote consignor and/or bidder that are the objects of the present invention;
- Clerk System interface that allows the on-line system to be kept in synchronization with the physical onsite live Auctioneer;
- Marquee System interface that announces to the on-site live Auctioneer incoming bids from a remote bidder;
- Bidder System interface that allows a remote bidder to participate in the live auction event; and

- Auction Messaging that provides the ability for the Auctioneer/Clerk to send text messages to a remote auction participant and for that selected remote auction participant to respond to the Auctioneer/Clerk.

The additions the remote consignor/bidder supplement for traditional live auctions of the present invention brings to the Remote Bidding Supplement for Traditional Live Auctions of U.S. patent application Ser. No. 09/866,191, include the following:

- A remote consignor function and console is added that allows a remote consignor to participate in two modes:
  - Message mode—In the message mode, the remote consignor simply responds to the Auctioneer and Clerk with the amount the remote consignor is willing to reduce the reserve price, the additional amount that is required to be added to the current high bid amount, or a signal that the consignor is willing to sell at the current high bid amount regardless of the reserve price.
  - Negotiation mode—In the negotiate mode, the consignor has the same capabilities included in the message mode plus the ability to respond to the high bidder with the amount the consignor is willing to reduce the reserve price, the additional amount that is required to be added to the current high bid amount, or a decision on the bidders' last "negotiation offer."
- The following capabilities are added to the Bidder System of the Remote Bidding Supplement for Traditional Live Auctions of U.S. patent application Ser. No. 09/866,191:
  - Message mode—the bidder simply responds to a message indicating the amount required to purchase the item at that time.
  - Negotiation mode—In addition to the message mode capabilities, the bidder is able to "counter offer" and thus enter a negotiation directly with the remote consignor.
- The Marquee System of the Remote Bidding Supplement for Traditional Live Auctions of U.S. patent application Ser. No. 09/866,191 is updated to display that the consignor is willing to sell at the high price or the new amount required for purchase. FIGS. 5 and 8 illustrate an updated Marquee System display in negotiation and messenger modes of the present invention.

While the remote consignor/bidder supplement for traditional live auctions of the present invention is preferably used to supplement the functions of the Remote Bidding Supplement for Traditional Live Auctions of U.S. patent application Ser. No. 09/866,191, it also can be used as a stand alone system when there are no remote bidders.

DETAILED DESCRIPTION OF THE PREFERRED EMBODIMENT

Functional Overview

During a live auction, it may become necessary for a bidder to negotiate with a consignor to determine if a price can be agreed upon between these two parties. The consignor establishes a minimum price (floor price) that will be acceptable to the consignor for the item being auctioned. When the highest bid for an item does not meet the floor price, negotiation between the last high bidder and the consignor is one means of achieving a sale. The remote consignor/bidder supplement for traditional live auctions of the present invention provides the ability for bidders and consignors to perform these negotiations in a number of situations:

When the bidder and consignor are both present at the live auction, the negotiation is performed face-to-face and the result entered by the auction Clerk;

When either the bidder or the consignor (or both) is remote from the on-site, live auction, the remote consignor/bidder supplement for traditional live auctions of the present invention provides the means for the bidder and consignor to perform the negotiation through electronic data interchange with the results being reported back to the auction Clerk.

Once a negotiation is initiated, the interchange conducted between the bidder and consignor enforces an offer/response structure to ensure that each side is able to directly respond to a proposal with either an acceptance or a counter-offer. In addition, either the bidder or consignor can terminate the negotiation process at any time and return to the live auction (in person or via a remote access system).

When the consignor or bidder, or both, are remote from the auction, an interface to the auction's hardware and software is required, such as the hardware and software disclosed in U.S. patent application Ser. No. 09/866,191. For live auction floor bidders who wish to negotiate with a remote consignor, the auction provides the hardware and software. These systems are directly connected to the remote consignor/bidder supplement for traditional live auctions of the present invention, which acts as a message intermediary in the negotiation mode. The remote systems will vary in technology. The requirement is that they are all capable of executing the remote consignor/bidder supplement for traditional live auctions client software and are compatible with the auction's hardware and software.

Function Operation

Figure 7:
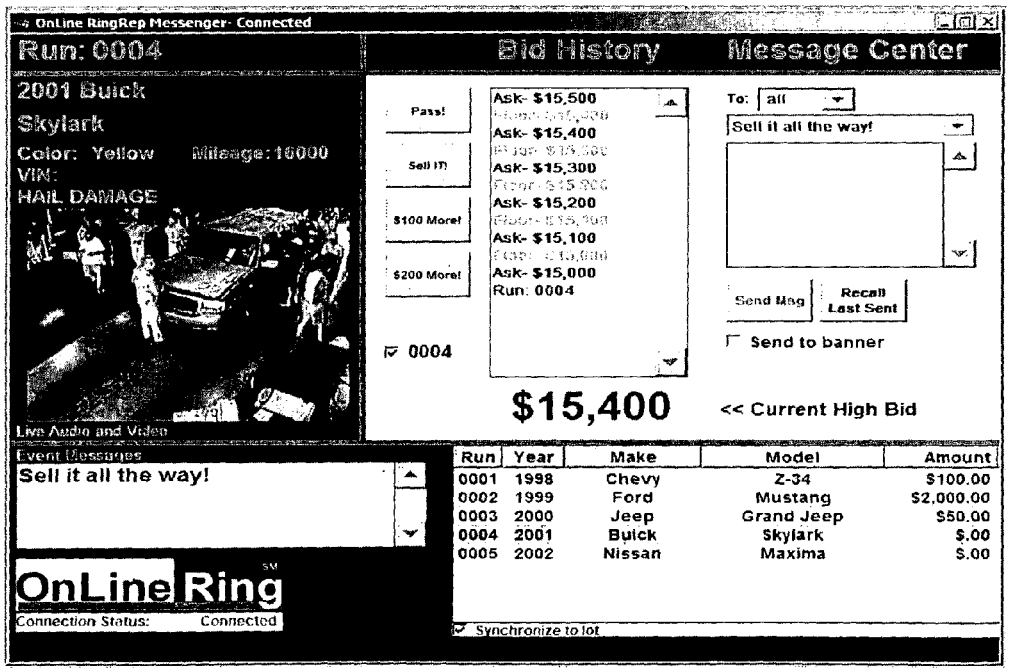
FIG. 7 illustrates an exemplary consignor console display in a messenger mode within the system of FIG. 1.
Figure 8:
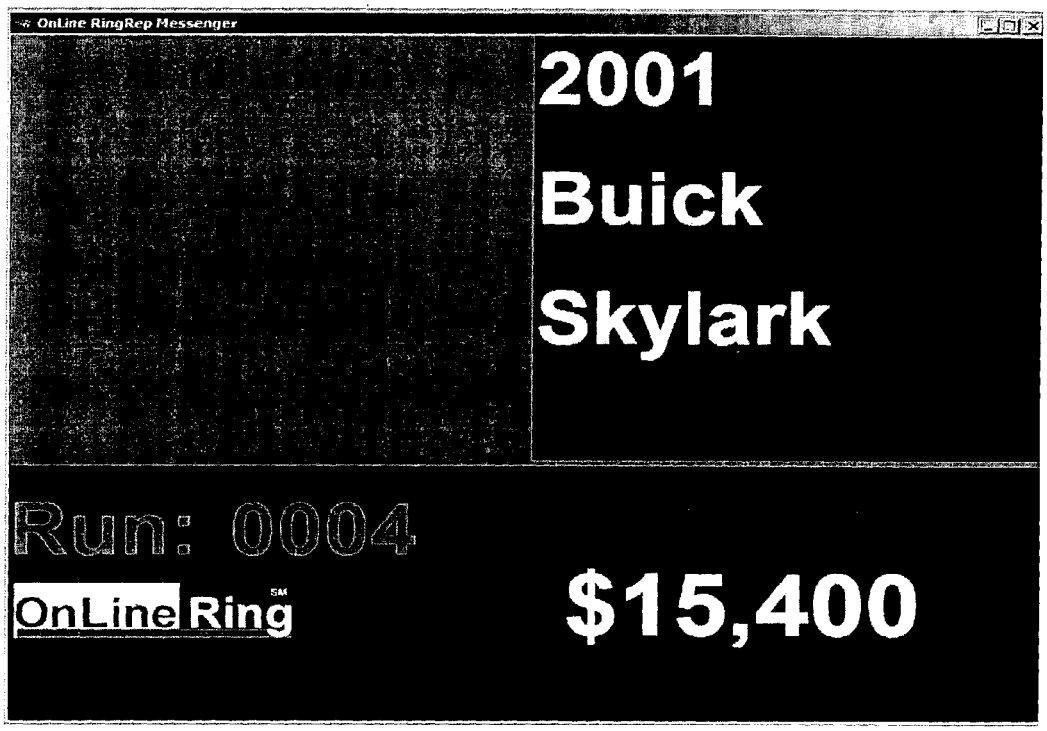
FIG. 8 illustrates an exemplary Marquee System display in a messenger mode within the system of FIG. 1.

When the consignor and bidder functions are in normal auction mode, the systems work functionally the same as the Bidder System defined in the Remote Bidding Supplement for Traditional Live Auctions of U.S. patent application Ser. No. 09/866,191. FIG. 7 illustrates an exemplary consignor console in the messenger mode of the present invention. When the negotiation is activated, the system activates the user interface on the respective devices to perform the negotiation mode enabled by the remote consignor/bidder supplement for traditional live auctions of the present invention.

Figure 1:
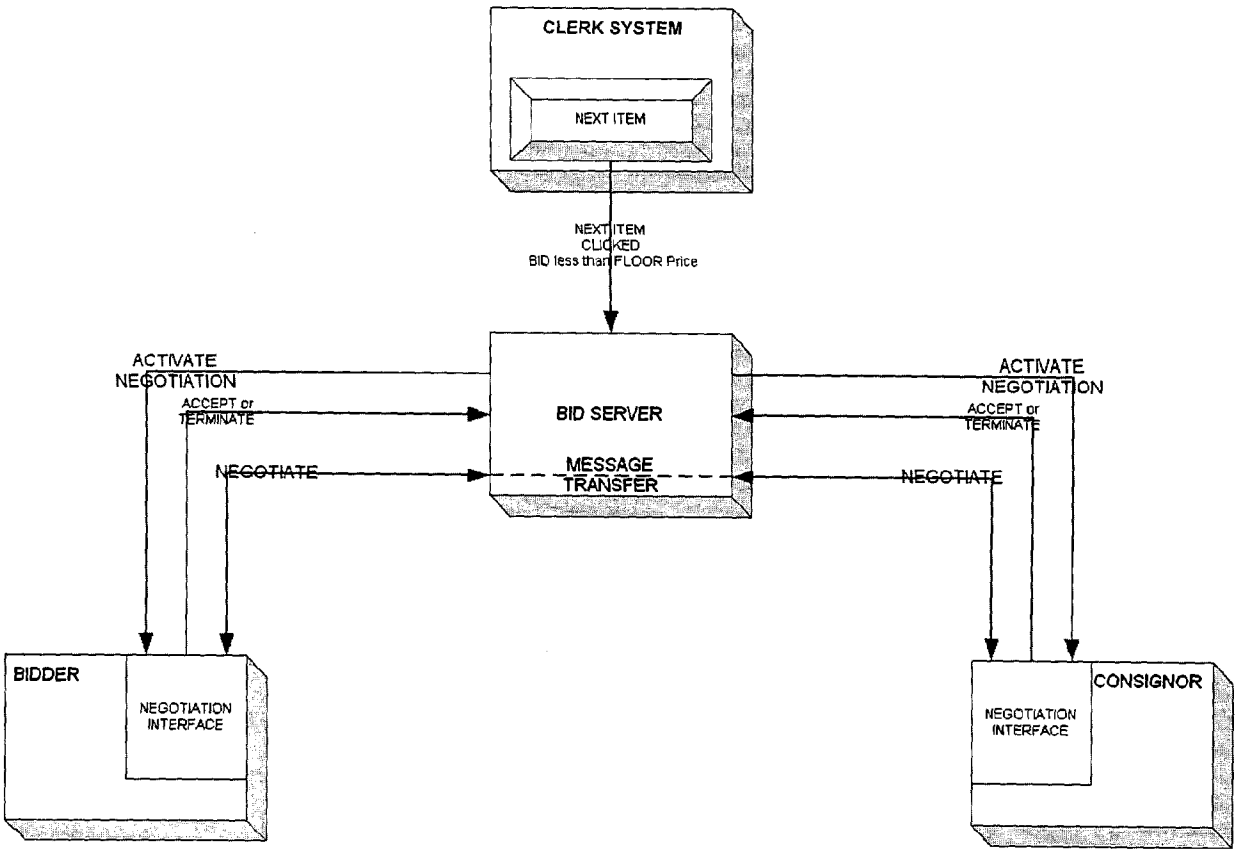
FIG. 1 illustrates a system overview of remote consignor/bidder supplement for traditional live auctions of the present invention.
Figure 2:
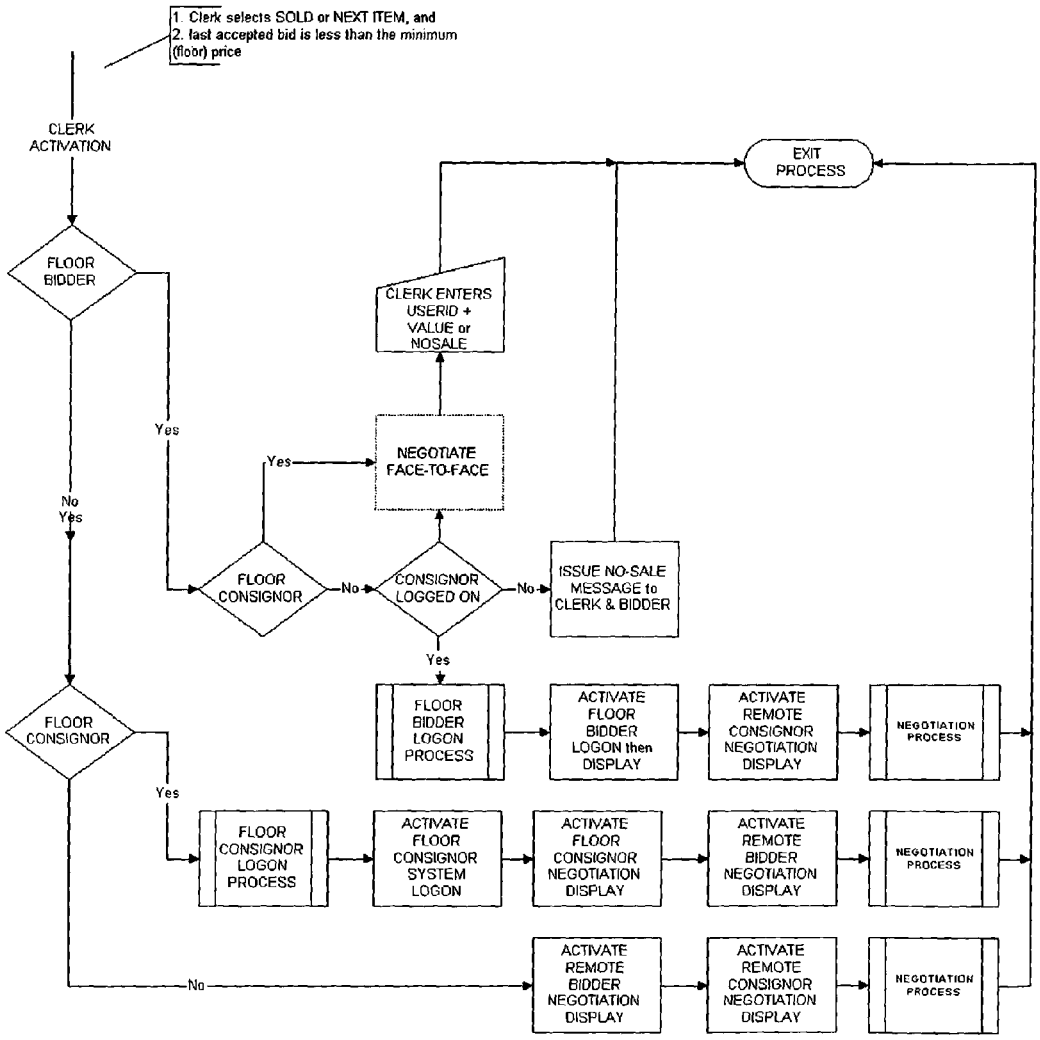
FIG. 2 illustrates the initial program flow of the system of FIG. 1.
Figure 3:
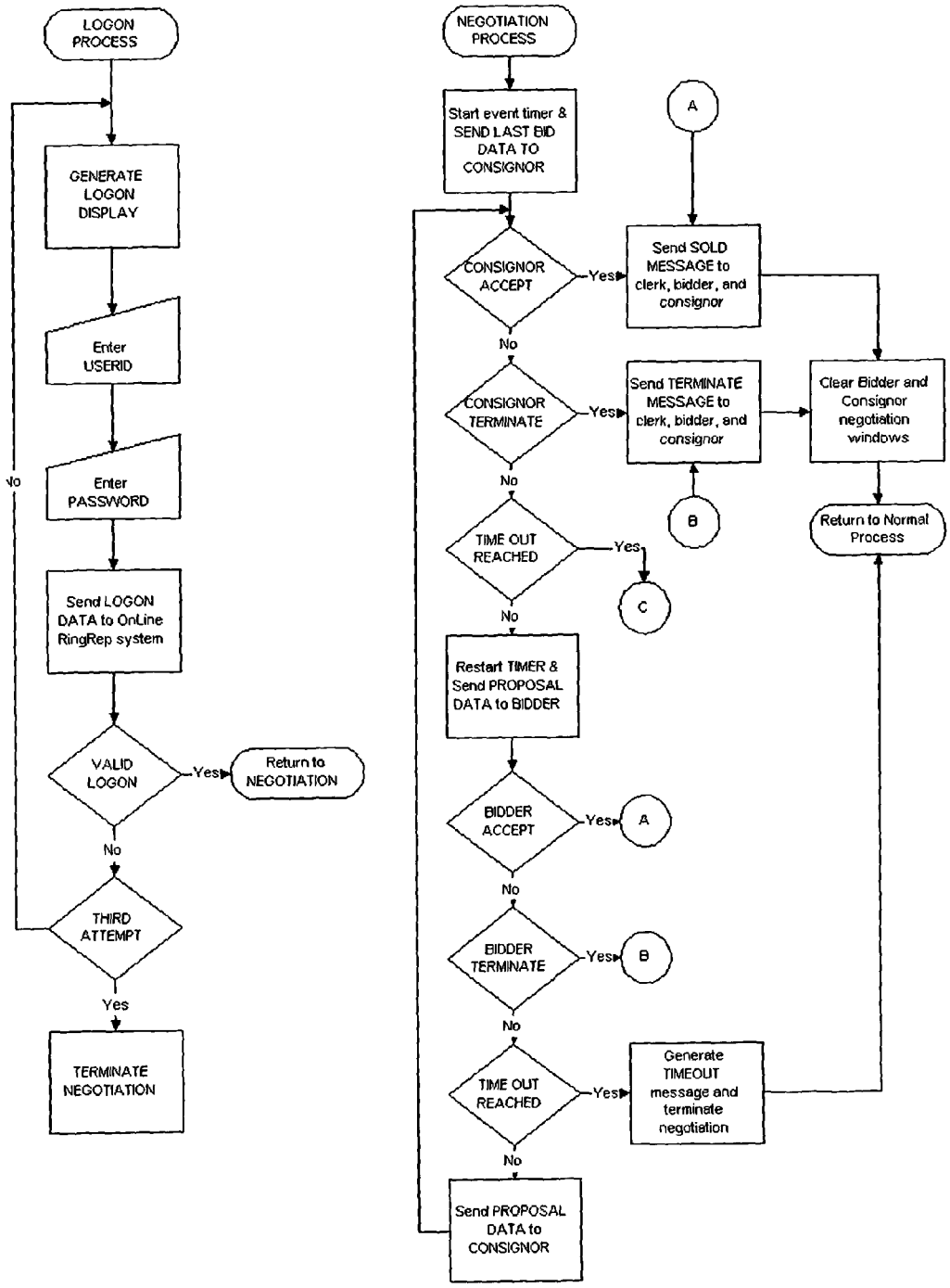
FIG. 3 illustrates the logon process and negotiation process flow of the system of FIG. 1.

FIG. 1 illustrates a system overview of the remote consignor/bidder supplement for traditional live auctions of the present invention; and FIG. 2 illustrates the initial program flow for negotiation activation of the system of FIG. 1; while FIG. 3 illustrates the logon process and negotiation process flow of the system of FIG. 1.

The function of the remote consignor/bidder supplement for traditional live auctions of the present invention is initiated by the Clerk System of the Remote Bidding Supplement for Traditional Live Auctions of U.S. patent application Ser. No. 09/866,191. Once the negotiation is initiated, the remote consignor/bidder supplement for traditional live auctions of the present invention acts as a message switch between the consignor and the bidder until their negotiation is complete. The criteria for initiation of the negotiation mode are:

1. The highest bid received for an item is less than the floor price established by the consignor prior to the start of the auction,
2. The Clerk System selects NEXT ITEM with or without selecting SOLD for the current item, and
3. The consignor is either located at the live auction or is logged onto the live auction through a remote system, such as the Remote Bidding Supplement for Traditional Live Auctions of U.S. patent application Ser. No. 09/866,191.

Figure 4:
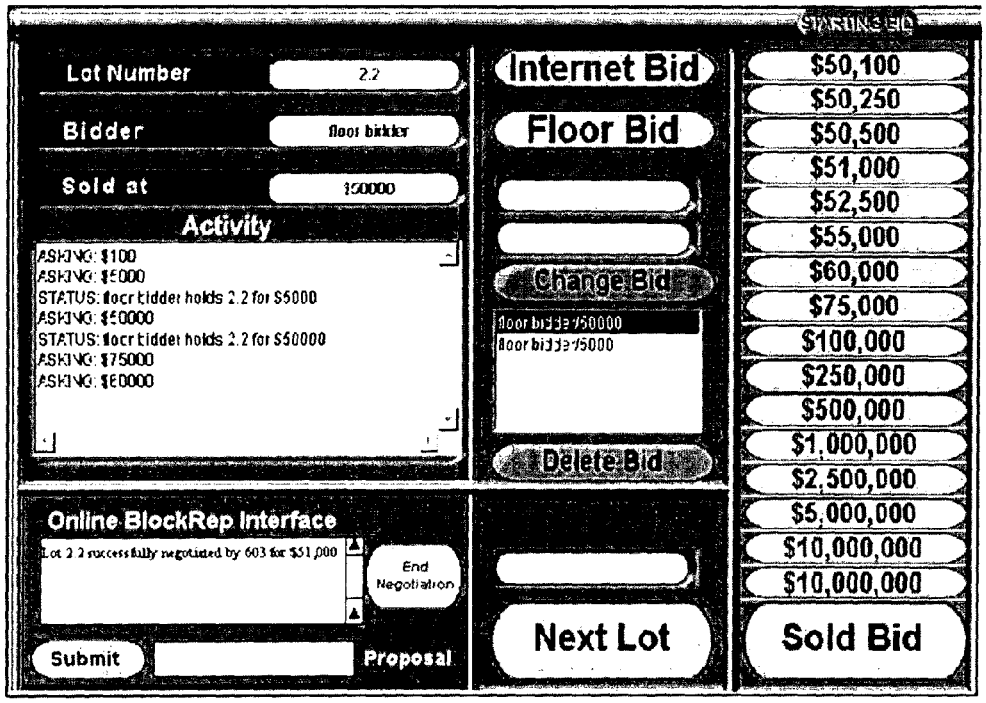
FIG. 4 illustrates an exemplary Clerk System display in a negotiation mode within the system of FIG. 1.

FIG. 4 illustrates an example of a Clerk System display in negotiation mode.

Consignor Options

The consignor is presented three options for each bid or counter-bid received from a bidder. These options include:

ACCEPT—the last bid (or counter proposal) received from the bidder is acceptable to the consignor and the consignor's auction item is considered sold by the consignor to the bidder. The remote consignor/bidder supplement for traditional live auctions of the present invention notifies the Clerk System and the Bidder System that the item has been SOLD for a specified amount.

TERMINATE—the consignor does not wish to continue negotiations. The remote consignor/bidder supplement for traditional live auctions of the present invention notifies the Clerk System and the Bidder System that a negotiation has been terminated by the consignor and the item is in a NO SALE.

NEGOTIATE—the consignor requests that an offer be forwarded to the bidder. For this case, the consignor is required to enter a proposed sale amount and click OK to activate the NEGOTIATE mode. The remote consignor/bidder supplement for traditional live auctions of the present invention transmits the price proposal to the bidder.

Figure 5:
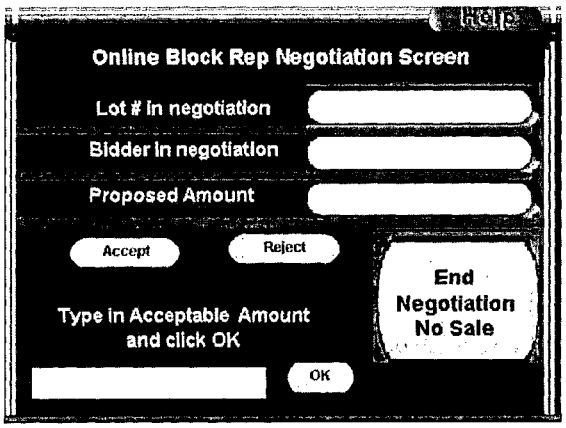
FIG. 5 illustrates an exemplary consignor display in negotiation mode within the system of FIG. 1.
Figure 6:
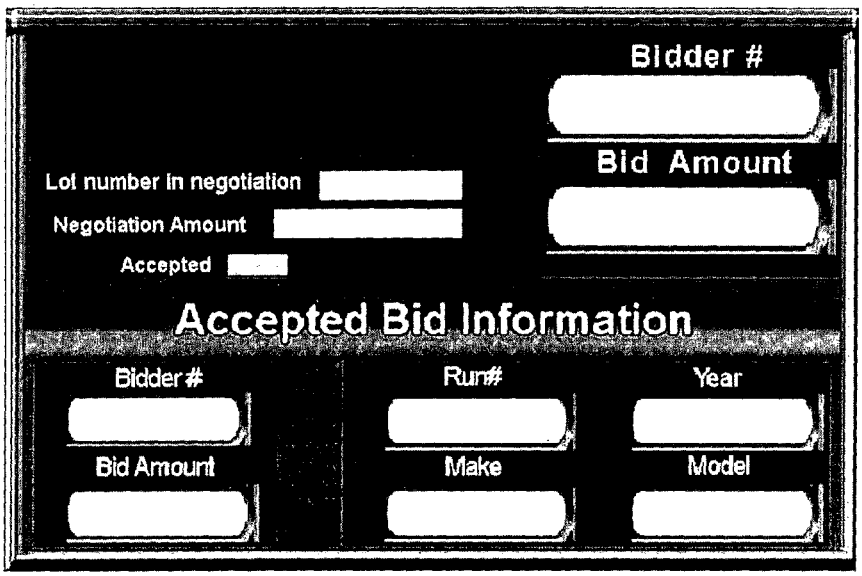
FIG. 6 illustrates an exemplary Marquee System display in a negotiation mode within the system of FIG. 1.

FIG. 5 illustrates an example of a consignor display during negotiation mode.

Bidder Options

The bidder has the same three options as the consignor:

ACCEPT—the last bid (or counter proposal) received from the consignor is acceptable to the bidder and the consignor's auction item is considered sold by the consignor to the bidder. The remote consignor/bidder supplement for traditional live auctions of the present invention notifies the Clerk System and the Bidder System that the item has been SOLD for a specified amount.

TERMINATE—the bidder does not wish to continue negotiations. The remote consignor/bidder supplement for traditional live auctions of the present invention notifies the Clerk System and the Bidder System that a negotiation has been terminated by the bidder and the item is in a NO SALE.

NEGOTIATE—the bidder requests that an offer be forwarded to the consignor. For this case, the bidder is required to enter a proposed sale amount and to click OK to activate the NEGOTIATE mode. The remote consignor/bidder supplement for traditional live auctions of the present invention determines that the proposed value is within the credit limit of the bidder and then transmits the proposal to the consignor. If the bidder does not have sufficient credit for the proposed bid, the negotiation is placed in TERMINATE status by the remote consignor/bidder supplement for traditional live auctions of the present invention with a message of INSUFFICIENT FUNDS sent to the Bidder System and Clerk System, and to the consignor.

Single Action Response Driven

For this process, each action by either the bidder or the consignor requires a response from the opposite party until an ACCEPT or TERMINATE function is recognized by the remote consignor/bidder supplement for traditional live auctions of the present invention.

Time-Outs

The remote consignor/bidder supplement for traditional live auctions of the present invention enforces a time out for each action initiated. The value is set by the on-site live auction to range from 15-60 seconds per action. An overall time limit for the negotiation is also set by the on-site live auction. This value can range from 1 minute to 3 minutes. These time limits are set prior to the live auction when the Clerk System function is activated. The default values are set to 30 seconds per action and two minutes per negotiation. The default values are utilized if the Clerk System does not specify time out values when prompted by the system. The system prevents any other Clerk System activity while the time out values are input by the Clerk System. To set values, the Clerk System selects values from the two drop down menu boxes, one for per action and one for the negotiation mode. Increments for values in the drop down boxes are preset to 15 seconds.

Auction Lockout Option

The live auction is given the option (at software installation) to select the lockout status to be used during the auction:

1. Auction activity using the Clerk System function can continue during a negotiation, or
2. Auction activity using the Clerk System function is discontinued until the negotiation is complete.

For option (1), above, the system is set up to include NEGOTIATION STACKING. For the second option above, this function is not required, as the on-site live auction does not continue until each negotiation is complete.

Negotiation Stacking

If the on-site live auction selects the option to continue the auction during a negotiation, it is possible that additional negotiations for the same consignor may be required for successive items while a given negotiation is in progress. The remote consignor/bidder supplement for traditional live auctions of the present invention stacks these negotiation requests in a queue and activates the next negotiation once the current negotiation is complete. Each consignor has a negotiation queue in the system such that multiple negotiations can be stacked for as many consignors as necessary to allow for conditions created by the time outs established by the auction coupled with the speed with which items are auctioned during the normal bidding process. A similar stacking process is used from the bidder's perspective.

This feature is also required for bidders and consignors who attend multiple simultaneous auctions via remote interfaces.

Consignor Not Logged In

If a consignor is not logged into the on-site live auction (defined by the auction as a remote consignor prior to the auction) at the time a negotiation mode is requested, the remote consignor/bidder supplement for traditional live auctions of the present invention recognizes the consignor as being unavailable, places a NO SALE status on the item and does not activate the negotiation.

Bidder Logged Out

Should the bidder log out of the live auction during a negotiation, the time-out feature recognizes this condition and TERMINATEs the negotiation based on the time-out.

Consignor/Bidder Lockout Function

During a negotiation process, the bidder and consignor systems used for the negotiation are locked out from the normal bidding activity if the on-site live auction is continued during negotiations.

Consignor/Bidder Notification

The consignor and bidder are notified of a negotiation mode by the activation of a 'user interface' on the display of their respective systems. The remote consignor/bidder supplement for traditional live auctions of the present invention recognizes the highest bid received as the first proposed bid to the consignor. The consignor window, therefore, initially includes the ACCEPT, TERMINATE, and NEGOTIATE options and is the first system that must respond.

Auction Setup

The remote consignor/bidder supplement for traditional live auctions of the present invention requires data structures to be established by the live auction as part of the data submitted to control the processing of each consignor item through the on-site live auction process. This data includes:

1. Consignor ID included in the item data in the specified field. If a negotiation mode is required, this ID is used to activate the consignor's system interface.
2. Floor price included in the item data in the specified field. A blank field denotes any price is acceptable for this item, therefore, no negotiation is possible (bid value would always exceed the floor price of blank=0)
3. The user file created by the live auction and uploaded to the remote consignor/bidder supplement for traditional live auctions of the present invention prior to the live auction requires that the live auction define whether or not each consignor will be in attendance (either at the auction or via a remote system). If the consignor is defined as not in attendance, no negotiation modes are initiated for that consignor. The remote consignor/bidder supplement for traditional live auctions of the present invention checks current logins to the live auction from remote consignors/bidders to determine if the consignor is currently logged in to the auction before checking the availability status in this table.

System Structure

The structure of the remote consignor/bidder supplement for traditional live auctions of the present invention allows the following consignor/bidder interfaces:

1. The normal structure for the bidder and consignor to negotiate, as necessary, on an item-by-item basis as the live auction progresses through the item list.
2. A multiple auction consignor userID/password can be established for a consignor who requires negotiation mode capability for simultaneous auctions. This requires the Negotiation Stacking feature previously described.
3. A multiple auction bidder userID/password can be established for a bidder who requires negotiation capability for simultaneous auctions. This requires the Negotiation Stacking feature previously described.
4. The system preferably allows up to five (5) consignor userID/password combinations to be linked (to a master consignor userID/password) together in a ring sequence to allow the next negotiation for that master consignor to go to the first available consignor representative.

Floor Bidder/Remote Consignor

For this condition, the on-site live auction provides a Bidder System at the live auction that is initially logged on by the on-site live auction as the bidder negotiation mode system. When a negotiation is activated, the remote consignor/bidder supplement for traditional live auctions of the present invention automatically brings up a loon window that requires the floor bidder to enter a userID and password. If accepted, the bidder negotiation mode window is generated. If not accepted after three tries, the remote consignor/bidder supplement for traditional live auctions of the present invention identifies the bidder as not available and terminates the negotiation as a NO SALE condition.

Remote Bidder/Remote Consignor

The negotiation process is conducted as previously described.

Remote Bidder/Floor Consignor

For this condition, the system referenced above for Floor Bidder/Remote Consignor is activated for a consignor login with the same conditions as stated previously.

Floor Bidder/Floor Consignor

Negotiation is conducted face-to-face. The result can be entered via the normal Clerk System SOLD function with capture of the floor bidder ID.

We claim:

1. A method for enabling direct negotiations between remote consignors and bidders within a traditional-style live auction system in which items are auctioned off in sub-ten-minute intervals, comprising the steps of:

providing audio/video system that streams instantaneously and buffer-free, live audio and video data from a live auction site to one or more remote auction consignors and bidders having bidding device for receiving the data and for transmitting instantaneously remote auction messages and bids for each consignor item being auctioned at a live auction site;

providing clerk system that controls and accepts auction bids received at the live auction site from onsite auction bidders and from remote auction bidders for each consignor item being auctioned at the live auction site;

providing marquee system that displays instantaneously at the live auction site auction bid information, including accepted auction bids and auction messages, for each consignor item being auctioned at the live auction site;

providing bid system that broadcasts instantaneously to all remote auction consignors and bidders and to the marquee system auction bid information for each consignor item being auctioned at the live auction site, for receiving instantaneously messages and auction bids to and from each remote auction consignor and bidder for each consignor item being auctioned at the live auction site, for transmitting instantaneously to the clerk system each remote auction bid received for each consignor item being auctioned at the live auction, and for broadcasting instantaneously to all remote auction consignors and bidders and to the marquee system the onsite and remote auction bids that are accepted by the clerk system; and enabling a negotiation function that is integrated with the auctioning system for enabling a window of time commensurate to a traditional-style live auction for direct price negotiations between a remote auction consignor and a highest remote auction bidder for at least one unsold consignor item, after completion of a portion of a live auction earmarked for the sale of said at least one unsold consignor item.

2. The method of claim 1, further comprising the steps of:

receiving an acceptance during the direct price negotiations window; and delivering an indication of the acceptance to the clerk system.

3. The method of claim 1, wherein the step of enabling the negotiation mode for enabling a window of time for direct price negotiations between a remote auction consignor and the highest remote auction bidder for a consignor item after commencement of a live auction for the consignor item occurs after the bidding for an item has not reached a reserve price and auctioning of a next item has commenced.

4. The method of claim 1, wherein when the window of time for direct price negotiations has expired either by a timeout or by an action of a bidder or remote auction consignor, continuing the live auctioning.

5. A method for enabling direct negotiation between consignors and bidders within a traditional-style live auction system, comprising the steps of:

providing audio/video system that streams instantaneously and buffer-free, live audio and video data from a live auction site to one or more auction consignors and bidders having bidding device for receiving the data and for transmitting instantaneously remote auction messages and bids for each consignor item being auctioned at a live auction site;

providing clerk system that controls and accepts auction bids received at the live auction site from auction bidders for each consignor item being auctioned at the live auction site;

providing marquee system that displays instantaneously at the live auction site auction bid information, including accepted auction bids and auction messages, for each consignor item being auctioned at the live auction site;

providing bid system that broadcasts instantaneously to all auction consignors and bidders and to the marquee system auction bid information for each consignor item being auctioned at the live auction site, for receiving instantaneously messages and auction bids to and from each auction consignor and bidder for each consignor item being auctioned at the live auction site, for transmitting instantaneously to the clerk system each auction bid received for each consignor item being auctioned at the live auction, and for broadcasting instantaneously to all auction bidders and to the marquee system the auction bids that are accepted by the clerk system; and enabling a negotiation mode that is integrated with the auctioning system for enabling a limited time window for direct price negotiations between auction consignors and auction bidders for one or more unsold consignor items after completion of a portion of the live auction earmarked to the sale of said one or more consignor items, the negotiations including offers, acceptances, counter-offers or rejections being subjective to response time constraints individually for each such operation.

6. The method of claim 5, wherein the traditional style live auction moves items at sub-ten-minute intervals and the limited time window for direct price negotiations is commensurate with operating within such a traditional-style live auction, the method further comprising the steps of:

receiving an acceptance during the direct price negotiations window; and delivering an indication of the acceptance to the clerk system.

7. The method of claim 5, wherein the step of enabling a negotiation mode is performed prior to a reserve price being reached by the bidders.

8. The method of claim 7, wherein the response time constraints require the consigner to present an offer to highest bidder within a predetermined time after the negotiation is activated.

9. The method of claim 8, wherein the response time constraints require the bidder to respond to the consigner within a predetermined time period.

10. The method of claim 9, wherein if any of the time constraints are not met, the auctioning system operating in negotiation mode notifies the clerk system that the negotiations have terminated.

11. The method of claim 10, wherein if the consigner and bidder reach an agreement within the time constraints, the auctioning system operating in the negotiation mode notifies the clerk system that the lot has sold.

12. The method of claim 5, wherein the step of enabling the negotiation mode is performed after the auction for a particular lot has concluded without a reserve price being reached by the bidders and further comprises the step of placing subsequent concluded auctions in which the reserve price is not met into a queue.

13. A method for providing, within the environment of a live auction including a live auction system that enables onsite and remote bidders to bid on lots with equal standing and in sub-ten-minute intervals for each item being auctioned, a time sensitive negotiation between a consignor and a bidder, at least one of which is remotely accessing the live auction system, the method comprising the steps of:

providing a live auction system that presents lots and accepts bids from remote and onsite bidders;

enabling a window of time commensurate to operation within a live auction system for direct price negotiations between a consignor and the highest bidder for at least one of said consignor's unsold items, after the completion of a time portion from a live auction that was earmarked for the sale of the at least one unsold consignor item; and notifying the live auction system as to a result of the direct price negotiation.

14. The method of claim 13, wherein each action between the consignor and bidder is subject to a time constraint.

15. The method of claim 14, wherein if a time constraint is not met, the live auction system receives a notification that the negotiations have terminated.

16. The method of claim 14, wherein if the consignor and bidder reach an agreement, the live auction system receives a sold notification.

17. The method of claim 14, wherein while the direct price negotiations are taking place, the live auctioning system proceeds with the auctioning of a next lot.

18. The method of claim 14, wherein when the window of time for direct price negotiations has expired either by a timeout or by an action of a bidder or remote auction consignor, continuing the live auctioning.

* * * * *